United States Patent [19]

Staeger

[11] Patent Number: 4,951,440

[45] Date of Patent: Aug. 28, 1990

[54] CONSTRUCTION SET FOR THE ERECTION OF A SUPPORTING STRUCTURE

[75] Inventor: Johannes E. O. Staeger, Neuweiler, Fed. Rep. of Germany

[73] Assignee: Octanorm-Vertriebs-GmbH für Bauelemente, Filderstadt, Fed. Rep. of Germany

[21] Appl. No.: 401,435

[22] PCT Filed: Nov. 12, 1988

[86] PCT No.: PCT/EP88/01029

§ 371 Date: Sep. 12, 1989

§ 102(e) Date: Sep. 12, 1989

[87] PCT Pub. No.: WO89/06724

PCT Pub. Date: Jul. 27, 1989

[30] Foreign Application Priority Data

Jan. 12, 1988 [DE] Fed. Rep. of Germany ..... 3800547

[51] Int. Cl.[5] ..... E04B 1/19; E04B 1/58

[52] U.S. Cl. ..... 52/646; 403/171; 403/172

[58] Field of Search ..... 52/646, 648, 650, 81; 403/171, 172, 176, 174

[56] References Cited

U.S. PATENT DOCUMENTS

| | | | |
|---|---|---|---|
| 2,931,467 | 4/1960 | Fentiman | 403/172 |
| 2,964,147 | 12/1960 | Fentiman . | |
| 2,976,968 | 3/1961 | Fentiman . | |
| 3,275,351 | 9/1966 | Fentiman | 403/171 |
| 3,563,581 | 2/1971 | Sommerstein . | |

FOREIGN PATENT DOCUMENTS

| | | | |
|---|---|---|---|
| 772856 | 12/1967 | Canada | 403/171 |
| 2457674 | 6/1976 | Fed. Rep. of Germany . | |
| 8330969 | 2/1984 | Fed. Rep. of Germany . | |
| 483819 | 2/1970 | Switzerland . | |

OTHER PUBLICATIONS

Article: Deutsche Bauzeitung, No. 3, 1967 (pp. 226–227).

*Primary Examiner*—John E. Murtagh

*Attorney, Agent, or Firm*—Burns, Doane, Swecker & Mathis

[57] ABSTRACT

A construction set for the erection of support structures comprises supporting rods and at least one connecting joint containing a plurality of mutually parallel chambers. Cylindrical beads are formed on the ends of supporting rods. Those beads are inserted into the cylindrical chambers of the connecting joint. The chambers are dimensioned to form a clearance relative to the beads in order to facilitate the insertion of the beads into the chambers. The beads are formed by a rolling-in of the free ends of the supporting rods.

7 Claims, 3 Drawing Sheets

CONSTRUCTION SET FOR THE ERECTION OF A SUPPORTING STRUCTURE

BACKGROUND OF THE INVENTION

The invention concerns a construction set for the erection of a supporting structure.

A supporting structure of the abovementioned type is known (DE-GM 83 30 969), is used for the erection of a supporting structure. In the known construction set a spherical connecting joint provided with four outer surfaces set an angle of 90° to each other, wheein in each of the surfaces a slot open to one side is located, the slots expanding inwardly in a shape of a T. Into these open slots suspension heads adapted to the profile of the T groove may be inserted, the suspension heads being mounted on the frontal sides of supporting beams.

The connecting joint has a center threading whereby it may be inserted by means of threaded bolts provided in suspension tubes extending flush with the threading. Following the insertion of the suspension heads of the vertical support beams, a closure disk is provided to hold the suspension heads by means of an intermediate piece also acting as fastening means to rotate the threaded bolts, when the connecting joint is screwed to the associated vertical suspension tubes. The supporting structures erected in this manner may consist only of vertical and horizontal beams perpendicular to each other. The assembly of such a structure is time consuming in view of the necessary screwing operations. Furthermore, the overall layout is expensive because of the numerous parts needed and their mutual mounting.

Another joint connection for structures assembled from rods is also known (DE-OS 24 57 674); it makes it possible to erect supporting structures for skeleton type constructions; is does not consist only of rods mounted perpendicularly to each other. In this configuration an element in the form of a hollow hemisphere is provided as the connecting joint, in which slots extending along large circles are located, into which the ends of supporting rods equipped with appropriate threaded pins and nuts or threaded heads may be inserted at different angles. With such connecting joints it is thus possible to erect tetrahedral or cubic base elements for supporting structures, assembled from a plurality of such base elements. However, in supporting structures of this type initially the manufacture of the necessary structural elements is relatively expensive; assembly is cumbersome and requires either that the inside of the hemisphere serving as the connecting joint be accessible for the insertion of the threaded heads or nuts, or that measures are taken to prevent the subsequent rotation of the support tubes, when the latter are moved with locking bar like heads behind the slots. The assembly of such a system is time consuming and complicated in view of the necessary screwing operation for each supporting rod.

Finally, regulations are known (Deutsche Bauzeitung, No. 3, 1967, p. 226), wherein the flattened ends of tube like rods made of aluminum, but for reasons of mechanical strength preferably of steel, are provided with notches and pressed axially and positively into the corresponding slots of a connecting joint. Assembly is expensive because of the clamped joint desired. Depending on the application, different extruded connecting joints and corresponding rods must be provided.

SUMMARY OF THE INVENTION

It is the object of the invention to create, in particular for use in exhibition buildings, a construction set for the erection of supporting structures that is simple in its design and makes possible the ready erection and disassembly of a supporting structure, in which the supporting rods may be assembled also at angles other than 90°.

This object is attained by providing a construction set according to the present invention wherein the supporting rods may be inserted very simply in a positively locking manner with their ends into the cylindrical clamps of the connecting joint. The positive locking action applied to relatively large surfaces renders it feasible to keep the forces generated relatively low. It is further possible therefore to use lighter materials both for the connecting joint and the support tubes than those customarily employed in supporting structures, without affecting the stability of the structure.

It is advantageous to form a bead at the flat ends of the support tubes by rolling in the free end. As the result of this measure, the support tube remains integral in spite of its cylindrical terminal piece, including the suspension piece. This facilitates production and there are no problems at the joints between the suspension parts and the support tube itself.

The support rods may be placed in different planes from a common connecting joint, which makes it possible to form pyramid like or tetrahedral base elements for the support structure. It is sufficient in all cases to introduce the beads created by the rolling in of the free ends of the flat pressed tubes from one end into the chambers of the connecting joint and then securing same in the chambers by a screwed on disk, which may be laid out in a particularly simple manner.

In the invention, in order to facilitate the manual insertion of the cylindrical beads into the corresponding chambers, a relatively large clearance is allowed between the beads and the chambers. However, in a supporting structure, depending on the tensile or compressive stresses generated, the tolerances add up at all of the connections, for example of an upper or lower chord, so that a certain sag is unavoidable, regardless of any additional load. To remedy this condition, the present invention provides two types of connecting joints, which are used at the locations of a supporting structure exposed to tensile or compressive forces. These so-called tensile or compressive nodes are laid out so that now there are no clearances on the side of the chambers against which the beads of the rods are resting. The sagging of a support structure due to tolerances can thereby be avoided, while adequate clearance is provided for the ready introduction of the cylindrical beads into the chambers connecting joints.

DESCRIPTION OF THE DRAWINGS

The invention is illustrated in the drawing relative to an example of embodiment and is described hereinafter. In the drawing.

DESCRIPTION OF A PREFERRED EMBODIMENT OF THE INVENTION

Figure 1:
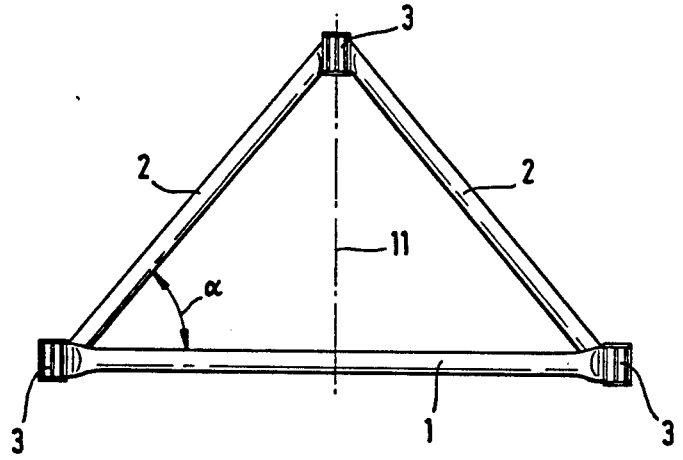
FIG. 1 shows a lateral elevation of a base element constructed from five connecting joints and eight supporting rods, for a support structure.
Figure 2:
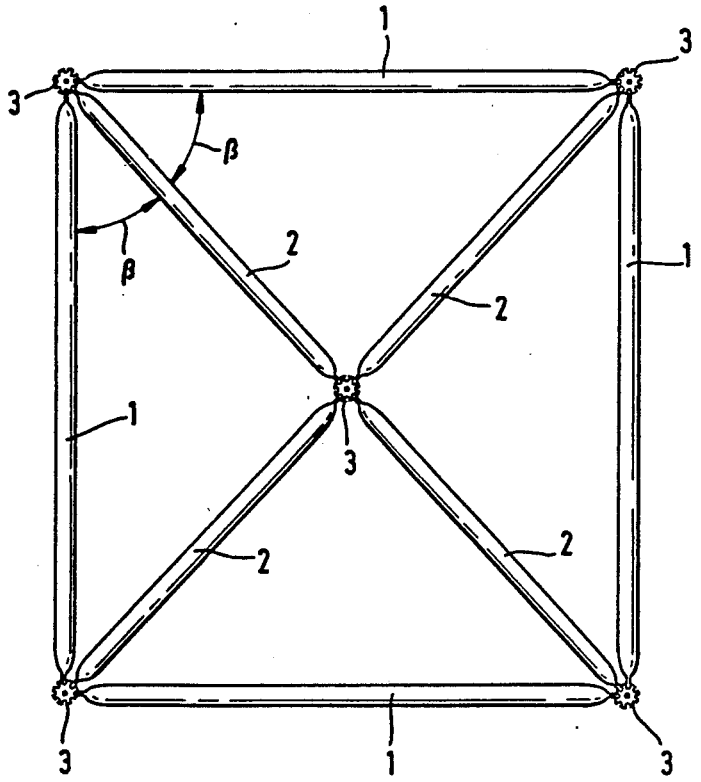
FIG. 2 depicts a top view of the base element of FIG. 1.

FIGS. 1 and 2 show a base element for the preparation of a support structure, made from a construction set according to the invention and which, as explained in connection with FIG. 9, may be combined with other similar base elements into a support structure. In the base element according to FIGS. 1 and 2, four supporting rods (1) are provided, the rods being laid out in the general shape of a pyramid with a square base and with four lateral surfaces in the form of isosceles triangles. The rods are held at their ends by connecting joints or profile sections (3), the configuration whereof is explained in connection with FIGS. 7 and 8. From some of these profile sections (3), four supporting rods (2) extend diagonally upward toward the center of the pyramid. In the center axis (11) standing perpendicularly to the base surface a fifth profile section (3) is located. The supporting rods (2) extend at an angle ($\alpha$) to the base surface, which in this example amounts to 37.5°. The angle ($\beta$) in the top elevation of FIG. 2 is 45°.

Figure 3:
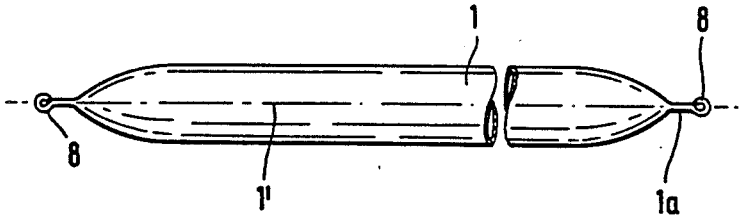
FIG. 3 depicts a top view of one of the supporting rods extending in the bottom plane of the base element.
Figure 4:
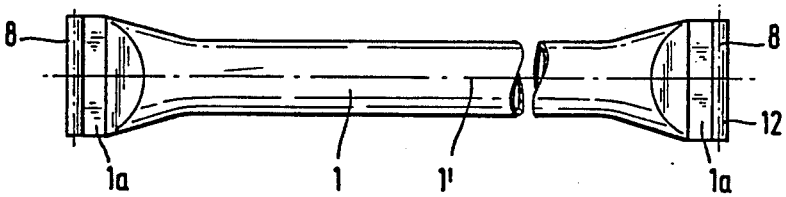
FIG. 4 shows a lateral elevation of the support rod of FIG. 3.

FIGS. 3 and 4 show that each of the supporting rods consists of a tube, pressed flat at both ends, and provided with flat areas (1*a*) passing over into an approximately cylindrical bead (8). The axis (12) of each of the two beads (8) is perpendicular to the axis (1') of the tube (1). The beads (8) are formed by rolling the free end (1*b*) (FIG. 8) of the flat terminal areas (1*a*) of the tube (1). This has the advantage of the integral and simple production of the tubes (1) including their connection zone. However, it would also be possible to rivet semicylindrical strips with the same height as the areas (1*a*) to the flat pressed zones, or provide hemispherical or oval coinings in the areas (1*a*) in both directions, so that in the top elevation according to FIG. 3 the approximately circular cross section obtained, which, as explained hereafter, is to be inserted into cylindrical chambers (6) of the profile sections (3).

Figure 5:
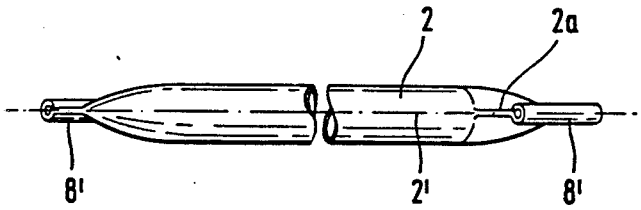
FIG. 5 is a top view of a supporting rod placed into a diagonal plane of the base elements of FIG. 1.
Figure 6:
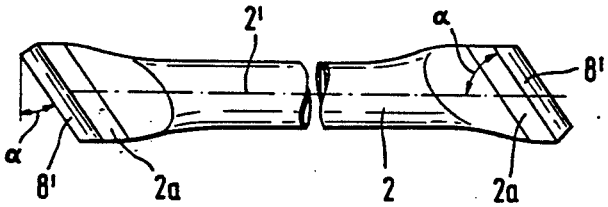
FIG. 6 depicts the lateral elevation of the supporting rod of FIG. 5.

FIGS. 5 and 6 show that the diagonally placed support tubes (2) are fundamentally alike. These support tubes (2) are flat pressed at their ends; the areas (2*a*) extend at an angle ($\alpha$) to the axis (2') of the support tubes (2). It follows that, as the free ends are again rolled in to form beads similar to the support tubes (1) the beads (8') will be approximately cylindrical with their axes extending at an angle ($\alpha$) to the axis (2') of the support tubes. The angle ($\alpha$) amounts to 37.5°, as already mentioned.

Figure 7:
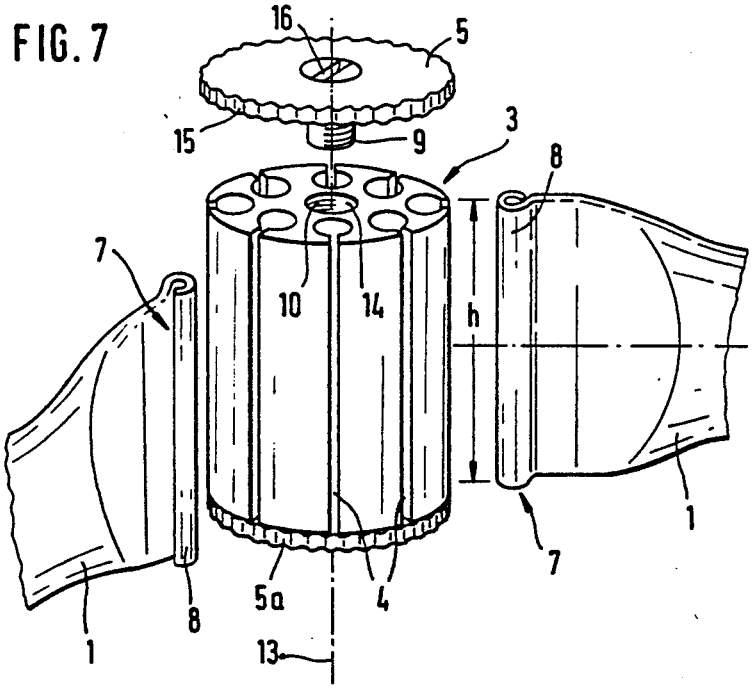
FIG. 7 is a schematic, perspective partial view of the ends to be inserted into a connecting joint of two supporting rods.
Figure 8:
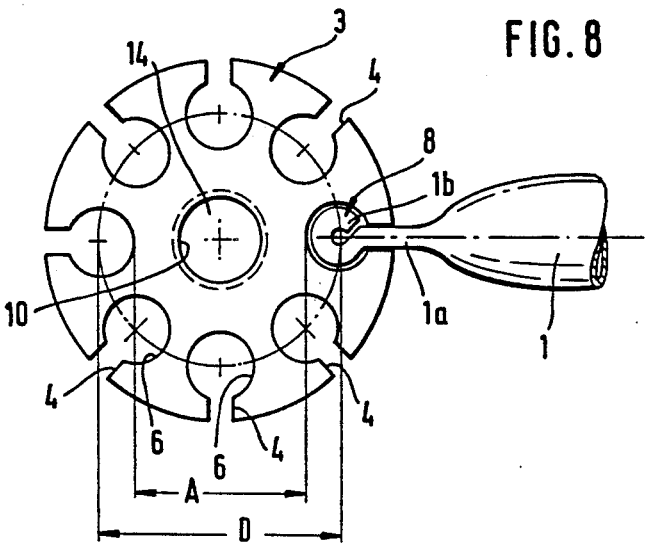
FIG. 8 depicts a top elevation of a connecting joint of FIG. 7 with a supporting rod inserted.

FIGS. 7 and 8 show that it is sufficient for the preparation of the base elements of FIGS. 1 and 2 (and obviously also for the installation of additional supporting rods in a support structure) to insert the beads 8 of the support rods (1) into the cylindrical chambers (6), whereby the support tubes (1) become secured in the profile section (3).

The profile section (3) is, in the example, a drawn section with an axial length (h), corresponding to the height (h) of the beads (8, 8') of the support rods (1 and 2). In this drawn profile, which for example may be made of aluminum, a plurality of slots (4) is distributed uniformly over the circumference, the slots opening into associated chambers (6), the axes whereof are extending parallel to the slots (4) and parallel to the axis (13) of the profile section (3), which for is basically cylindrical. The width of the slots leading out of the chambers (6) is slightly larger than the width of the flat pressed ends (1*a*) of the support tubes (1 and 2). The diameter of the chambers (6) corresponds approximately to the diameter of the beads (8 and 8'), formed by the rolling in of the free ends (1*b*) of the flat terminal ends (1*a*). In this manner, in spite of the slight clearance provided for the insertion of the beads into the chambers, following the introduction of the beads (8, 8'), a certain positive locking effect is obtained, which is sufficient to hold the support rods (1, 2) in the profile section (3). The positively abutting surfaces of the beads (8, 8') and the chambers (6) are relatively large. As the surface pressure is kept relatively low in this fashion, it is again possible to make the support tubes (1 and 2) of aluminum. The support structure erected from the construction set according to the invention can therefore be made relatively light. This is important for example in the erection of fair and exhibition buildings, where the individual parts required for the structure must always be transported both prior and following the assembly and disassembly, the handling of lighter parts is again simpler.

The profile section (3) is, as shown in FIG. 7, closed off at its bottom end by a disk (5*a*) of the same diameter as the profile section (3). But it may also be closed at its opposite end by another disk (5*a*) identical with said disk (5), when all of the beads (8, 8') of the support rods (1, 2) needed for the assembly are inserted. The disk (5) is provided for the purpose in its center with a stationary screw (9), that may be screwed into corresponding threads of a bore (14) extending through the profile section (3). The disk (5) (and similarly the disk (5*a*)) is provided with knurling (15) at its periphery, so that it may be screwed easily by hand into the threading (10). A depression (16) provided for the application of the tool and which may also be in the form of an internally hexagonal opening, finally makes possible a fixed screw joint.

Figure 9:
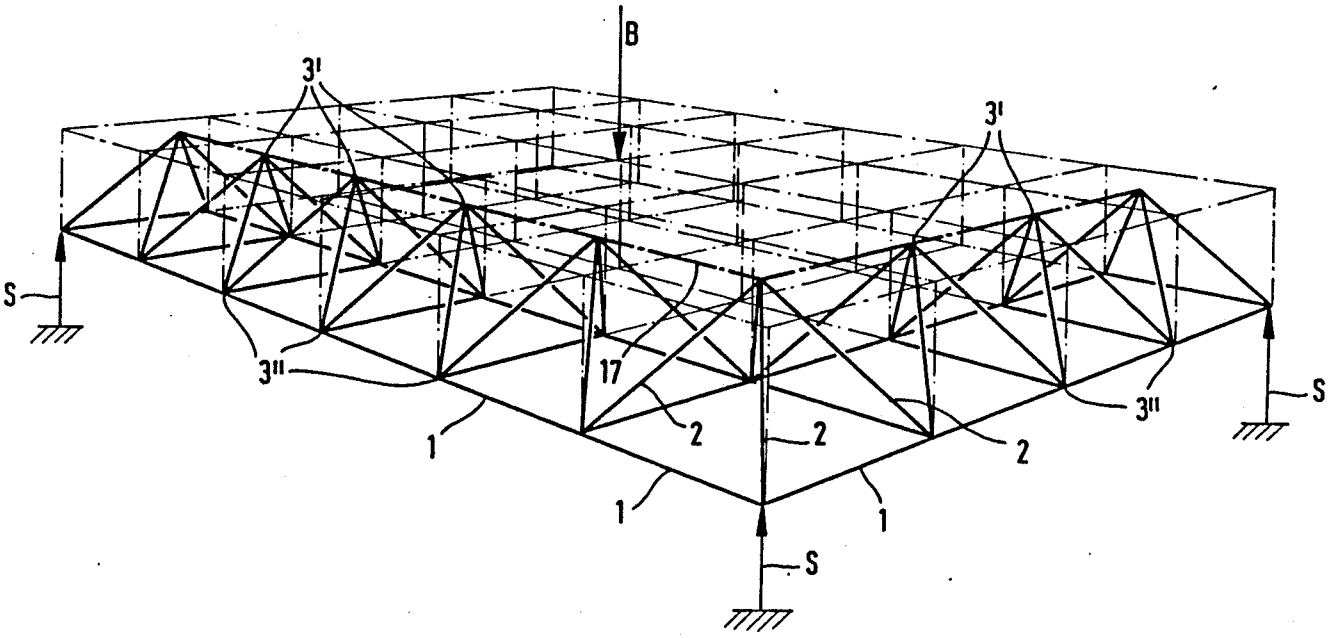
FIG. 9 depicts the erection of a support structure from a set according to the invention using the base elements shown in FIGS. 1 and 2.

As clearly seen in FIGS. 1 and 3, a support structure according to FIG. 9 may be erected from the base elements indicated therein, wherein successively to the support rods (1) placed in the base surface of the pyramid of the base elements and flush with them, the support rods (1) of an adjacent pyramid may be located and the tips of the two adjacent pyramids may be joined together by a connecting piece (17), which again consists of a support rod (1). However, for the sake of clarity, here in place of (1), the reference symbol (17) is used.

It is obviously also possible to reinforce the pyramids serving as the base elements in their base surface by introducing additionally shorter diagonal struts, which in the top elevation according to FIG. 2 are located under the support rods (2) extending obliquely upwards and corresponding in their length to one-half of the diagonal of the square base surface.

It is obviously also possible to use other shapes in place of the pyramid like base elements with a square ground projection. The eight chambers located in a rotation symmetrical manner in the profile section (3) make it possible to place up to eight supporting rods (3) in a plane extending perpendicularly to the axis of the profile section (3) or at an angle ($\alpha$), which may be variable. However, it has been found that one construction set of the two supporting rods (1 and 2) according to FIGS. 3 to 6 and the profile section (3) with the disks (5, 5*a*), optionally also with the aforementioned diagonal struts, is sufficient to realize all of the supporting structure forms usually desired.

As already mentioned, between the beads (8, 8') and the associated chambers (6) a certain clearance is provided, making possible the easy insertion of the beads into the chambers without the use of tools. However, the tolerances that must be observed for that purpose lead to the fact that a supporting structure as shown in FIG. 9, if standing with supporting columns (S) at the four outside corners on the ground and possibly additionally loaded in the direction of the arrow (B), will be sagging in the center. This could result in a considerable sagging of the center of the support structure in the case of large span widths, depending on the length of the rods used and the number of connecting joints. This sag may amount to several cm and may even be observed optically.

In order to prevent such sagging, two different types of connecting joints may be provided, which while similar in their design principle, differ from each other in the masses (A and D) shown in FIG. 8. Thus, for example, in a support structure according to FIG. 9 (a downwardly supported roof) so-called tensile connectors (3'') and compressive connectors (3') are provided, which are installed in the lower chord (tensile connectors (3'')) and the upper chord (compressive connectors (3')). As is immediately obvious, all compressive connectors (3') of the support structure according to FIG. 9 are stressed in compression and all tensile connectors (3'') in tension.

The tensile and compressive connectors are laid out so that the measure (D) and the measure (A) which depends on it with identical chamber cross sections, is smaller at the tensile connector (3'') by the sum of the permissible tolerances between the beads (8, 8') and the chambers (6) than at a compressive connector (3'). In this manner, all tolerances are displaced outward at the compressive connector (3') and toward the center at the tensile connector (3''). Tolerance dependent saggings of the support structure are thereby eliminated.

In an example with a connecting joint according to FIGS. 7 and 8, with an outside diameter of about 45 mm, the measure (D) for the tensile connector (3'') may amount for example to 31.5 mm and for the compressive connector (3') to 33.5 mm. For this reason, diameters of approximately 9 mm were provided for the chambers (6). Total permissible tolerances here amount to about 1 mm per connecting joint (the clearance between each bead and chamber is about 0.25 mm), so that the difference for the diameter measure (D) of approximately 2 mm is formed.

Evidently, different deviations in measurements and therefore other differences in the (D) measure for compressive and tensile connectors are possible.

I claim:

1. Construction set for the erection of support structures, comprising supporting rods and at least one connecting joint, said connecting joint containing a plurality of mutually parallel slots open at one end for receiving, in a positively locking manner, suspension heads of said rods which are wider than said slots, said suspension heads being held in said slots by a disk covering said one end of said slots, said slots opening into parallel and approximately cylindrical chambers of said connecting joint, said chambers having equal lengths corresponding to the lengths of said slots, said suspension heads being in the form of thickenings corresponding to the length of said chambers and adapted in shape to the cross-section of said chambers, and thickenings being located on flat pressed ends of said supporting rods, said thickenings being in the form of generally cylindrical beads, said chambers being dimensioned to form a clearance relative to said beads to facilitate the insertion of said beads into said chambers wherein said beads are formed by a rolling-in of the free ends of said flat pressed ends of the supporting rods.

2. Construction set according to claim 1, wherein said beads extend at an angle of 90 degrees relative to a longitudinal axis of respective ones of said supporting rods.

3. Construction set according to claim 1, wherein said beads extend at an angle other than 90 degrees relative to a longitudinal axis of respective ones of said supporting rods.

4. Construction set according to claim 1, wherein said chambers extend completely through said connecting joint, and first and second disks are threadedly connected to respective ends of said connecting joint to close-off said chambers.

5. Construction set according to claim 4, wherein each of said disks includes a threaded post projecting from a center thereof and being threadedly received in a threaded center hole of said connecting joint.

6. Construction set according to claim 1, wherein there are eight of said chambers arranged symmetrically relative to a center axis of said connecting joint.

7. Construction set according to claim 1, wherein there are two of said connecting joints connected at respective ends of said supporting rods, said chambers of each of said connecting joints being arranged on an imaginary circle, the imaginary circle of one of said connecting joints being smaller than that of the other connecting joint.

* * * * *